US007267561B2

(12) United States Patent
Lai et al.

(10) Patent No.: US 7,267,561 B2
(45) Date of Patent: Sep. 11, 2007

(54) CARD CONNECTOR CAPABLE OF AVOIDING ERRONEOUS INSERTION OF ELECTRONIC CARD

(75) Inventors: Yaw-Huey Lai, Taipei County (TW); Dong-Chu Feng, Huna Province (CN)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/319,634

(22) Filed: Dec. 29, 2005

(65) Prior Publication Data

US 2007/0155244 A1 Jul. 5, 2007

(51) Int. Cl.
*H01R 13/44* (2006.01)

(52) U.S. Cl. ..... 439/138; 439/633

(58) Field of Classification Search ..... 439/630, 439/64, 946, 745, 377, 138, 633
See application file for complete search history.

(56) References Cited

U.S. PATENT DOCUMENTS 5,035,633 A * 7/1991 Kobayashi et al. ..... 439/140
6,120,309 A * 9/2000 Hara ..... 439/159
6,511,350 B1 * 1/2003 Ito et al. ..... 439/680
7,044,757 B1 * 5/2006 Yen ..... 439/138
2005/0142934 A1 * 6/2005 Cheng ..... 439/541.5

* cited by examiner

*Primary Examiner*—Tho D. Ta
*Assistant Examiner*—Vanessa Girardi
(74) *Attorney, Agent, or Firm*—Bacon & Thomas, PLLC

(57) ABSTRACT

A card connector includes a base having an opening at a front end thereof, two guide channels at bilateral sides inside, and a plurality of terminals mounted at a rear end thereof; at least one movable member movably mounted in the guide channels and having a stopping portion and a bevel formed at upper and lower sides of a front end thereof; a stopping plate pivotably mounted to the base for pivoting movement between a stopping position and a releasing position. While the stopping plate is located at the stopping position, the movable member engages to lock the stopping plate. While the movable member is close to the guide channel, the movable member releases the lock-up status. At least one resilient member is provided for generating resilience keeping movement of the stopping plate toward the stopping position. Therefore, the card connector allows/blocks the normally/erroneously inserted card.

5 Claims, 12 Drawing Sheets

CARD CONNECTOR CAPABLE OF AVOIDING ERRONEOUS INSERTION OF ELECTRONIC CARD

BACKGROUND OF THE INVENTION

1. Field of the Invention

The present invention relates generally to electronic apparatuses, and more particularly, to a card connector capable of avoiding erroneous insertion of an electronic card for protection of terminals thereof.

2. Description of the Related Art

A conventional card connector is adapted for, for example, compact flash (CF) cards. Because the CF card is designed with larger width, while inserting the card, the user may carelessly insert the card with 90-degree rotation with respect to the normal direction into the card connector, as shown in FIG. 12. Such erroneous insertion may enable an edge of the card 91 to impinge terminals 70 mounted inside the card connector 70 and to incur deformation or fracture of the terminals 79 thus disabling the card connector for malfunction.

SUMMARY OF THE INVENTION

The primary objective of the present invention is to provide a card connector capable of avoiding erroneous insertion of an electronic card that allows the card for passing therethrough while the card is normally inserted, and blocks the card from entry while the card is erroneously inserted, preventing the card from impinging the terminals and preventing the terminals from deformation or fracture.

The foregoing objective of the present invention is attained by the card connector, which includes a base, at least one movable member, and a stopping plate. The base has an opening, two guide channels, and at least one retaining portion. The opening is formed at a front end thereof. The two guide channels are formed at bilateral sides inside the base, extending inward from the opening. The retaining portion is formed at least one side of a front section of the base. A plurality of terminals are mounted at a rear end of the base. The movable member is limited by the retaining portion in the guide channel for movement close to or away from the guide channel within a predetermined range. A first resilient member is mounted between the movable member and the guide channel for generating resilience keeping the movable member away from the guide channel. The movable member has a stopping portion formed at an upper side of a front end thereof, a bevel formed at a lower side of the front end thereof and protruding increasingly inward, and a lock-up recess formed at a lateral side thereof. The stopping plate is elongated in shape, having its two ends pivotably mounted to the base for pivoting movement, between a stopping position and a releasing position, caused by an external force. The stopping plate has a lock-up portion located close to a side of the movable member. While the stopping plate is located at the stopping position, the movable member is moved away from the guide channel and the lock-up portion engages the lock-up recess. While the movable member is close to the guide channel, the lock-up recess is moved away from the lock-up portion to release lock-up status to be located at the releasing position. The at least one resilient members is located between the base and the stopping plate for generating resilience keeping movement of the stopping plate toward the stopping position. Therefore, the present invention allows successful insertion of the card while the card is normally inserted into the card connector and let the stopping plate or the movable member block the erroneous insertion of the card to further protect the terminals from damage of crash.

DETAILED DESCRIPTION OF PREFERRED EMBODIMENTS

Figure 1:
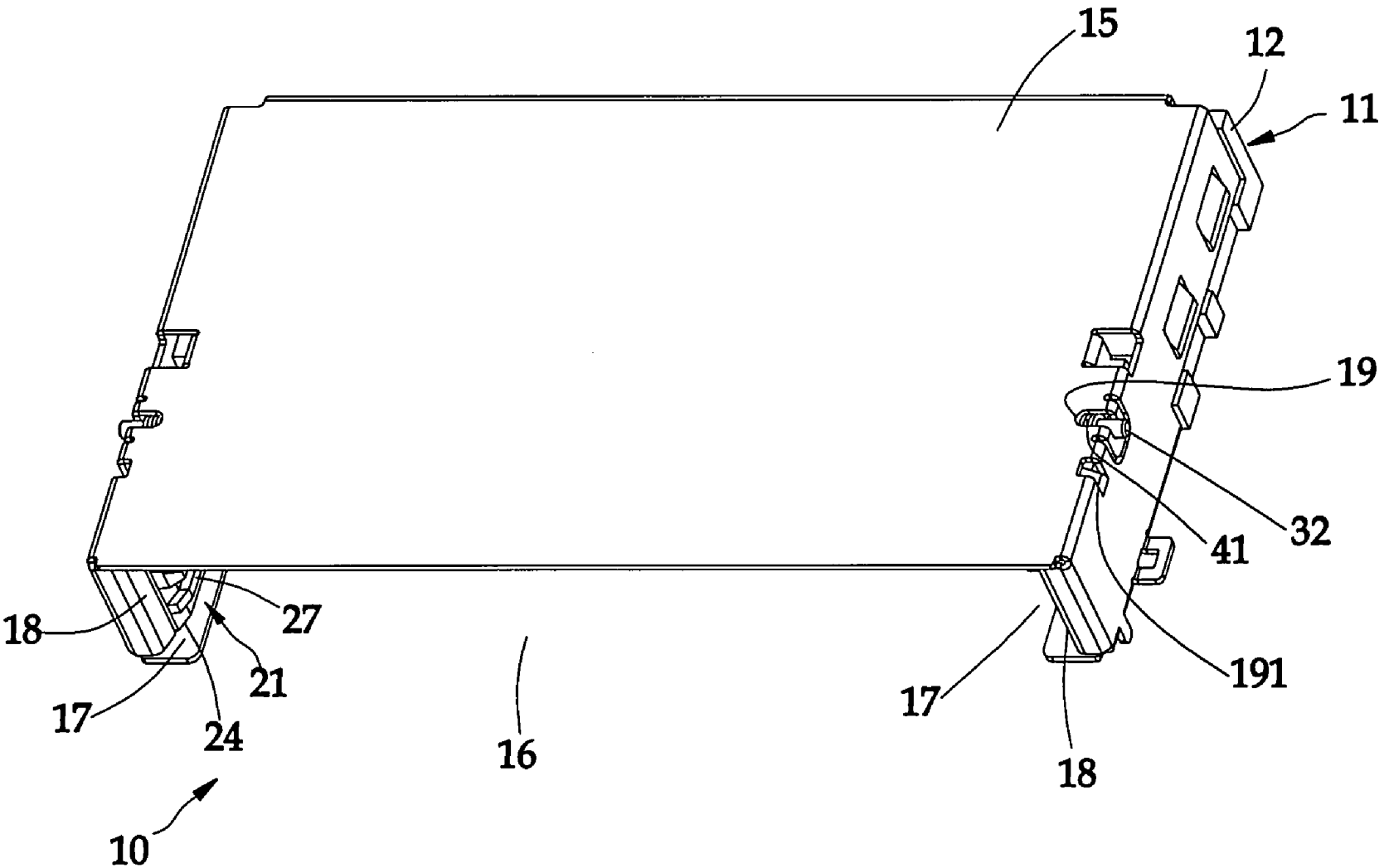
FIG. 1 is a perspective view of a preferred embodiment of the present invention.
Figure 2:
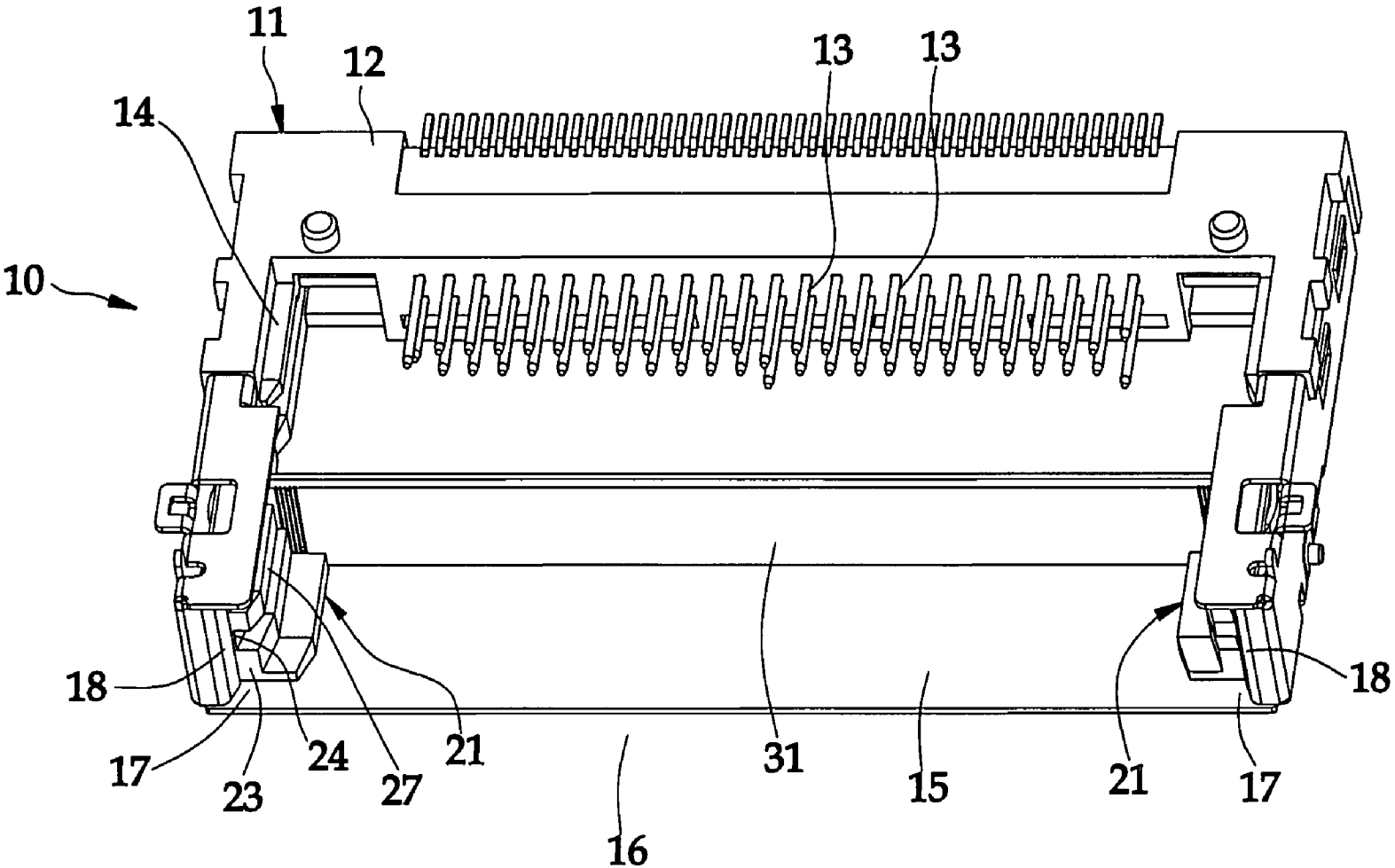
FIG. 2 is a bottom view of the preferred embodiment of the present invention.
Figure 3:
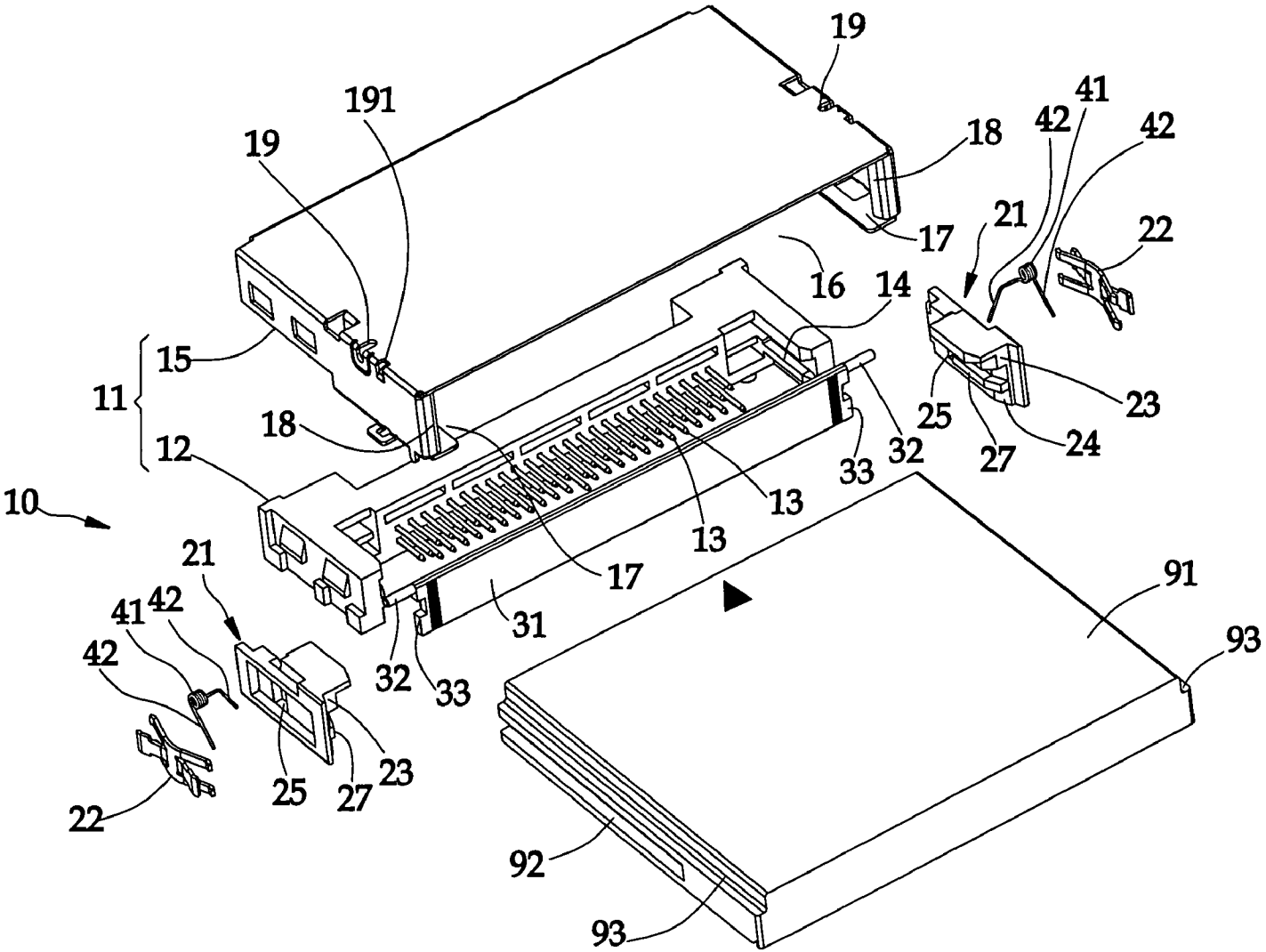
FIG. 3 is an exploded view of the preferred embodiment of the present invention.
Figure 4:
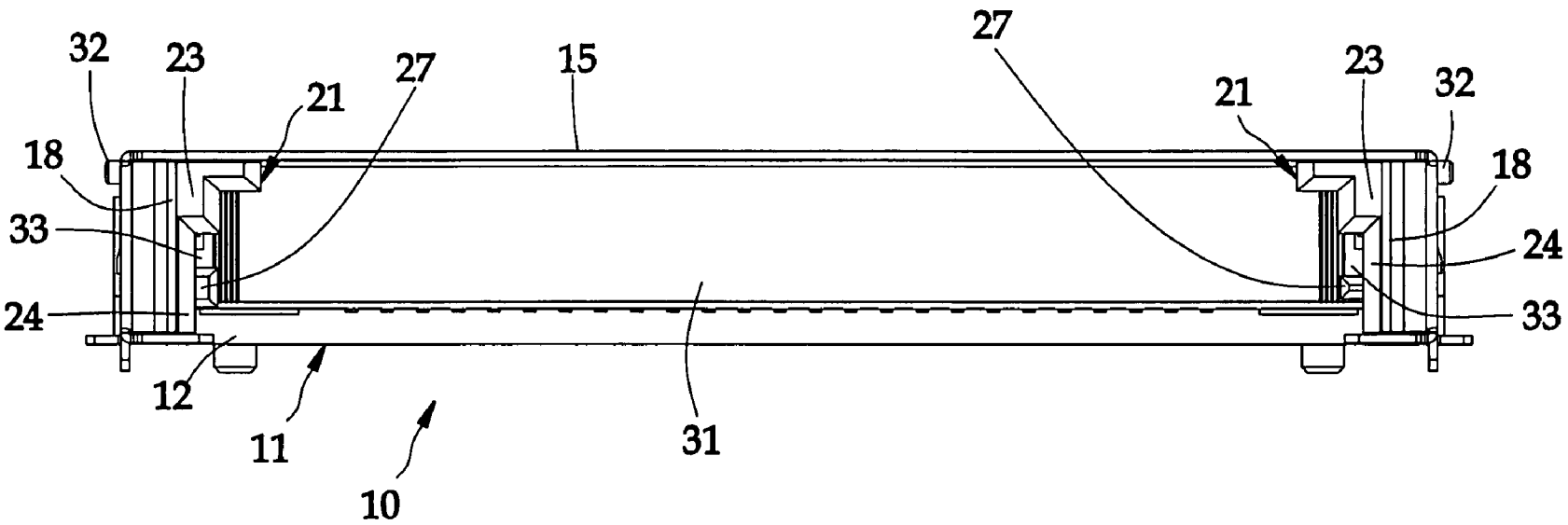
FIG. 4 is a front view of the preferred embodiment of the present invention.

Referring to FIGS. 1-6, a card connector 10 capable of avoiding erroneous insertion of an electronic card, constructed according to a preferred embodiment of the present invention, includes a base 11, two movable members 21, and a stopping plate 31.

The base 11 is composed of a frame 12 and a cover 15 mounted on the frame 12. The frame 12 has a plurality of terminals 13 mounted at a rear end thereof, and two guide ribs 14 mounted at bilateral sides inside the frame 12. The cover 15 has an opening 16 formed at a front end thereof, two guide channels 17 formed at bilateral sides of the cover 15 respectively and extending inward from the opening 16, two retaining portions 18 formed at bilateral sides of a front section of the two guide channels 17 respectively, and a through hole 19 and a cavity 191 formed at predetermined positions of bilateral sides of the cover 15 respectively.

The two movable members 21 are limited to the two guide channels by the two retaining portions 18, such that the two movable members 21 are moved within a predetermined range close to or away from the guide channels 17. Two first resilient members 22 are mounted between the two movable members 21 and the two guide channels 17 respectively, defined as two plate-like springs in this embodiment for generating resilience keeping the movable members 21 away from the guide channels 17 respectively. Each of the two movable members 21 has a stopping portion 23 formed at an upper side of a front end thereof, a bevel 24 formed at a lower side thereof of the front end thereof and protruding increasingly inward, and a lock-up recess 25 formed at a lateral side thereof. The two movable members 21 each further have a guide rib 27 formed at two sides thereof face to face and extending transversely.

The stopping plate 31 is elongated in shape, having two pivot portions 32 formed at two ends of an upper side thereof and extending outward. The two pivot portions 32 run through the through holes 19 to be pivoted to the cover 15 to enable the stopping plate 31 for pivoting movement caused by an external force to be between a stopping position and a releasing position. The stopping plate 31 has two lock-up portions 33 formed at bilateral sides thereof close to the two movable members 21. While the stopping plate 31 is located at the stopping position, the two movable members 21 are away from the guide channels 17 to engage the stopping plate 31, enabling the lock-up portions 30 to extend into the lock-up recesses 25. While the two movable members 21 approach the two guide channels 17, the lock-up recesses 25 are moved away from the lock-up portions 33 to be located at the releasing position.

Figure 5:
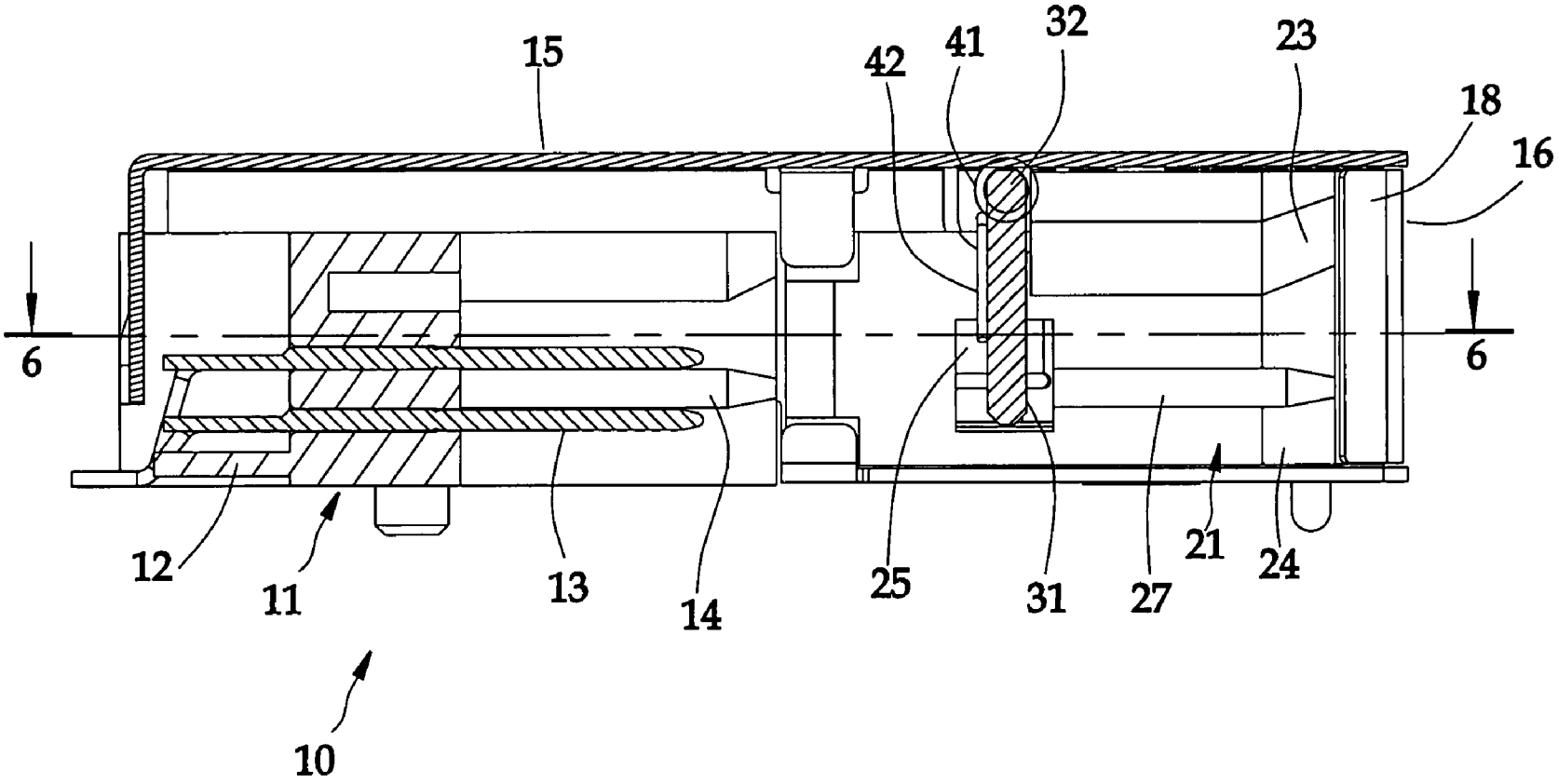
FIG. 5 is a sectional view of the preferred embodiment of the present invention.
Figure 6:
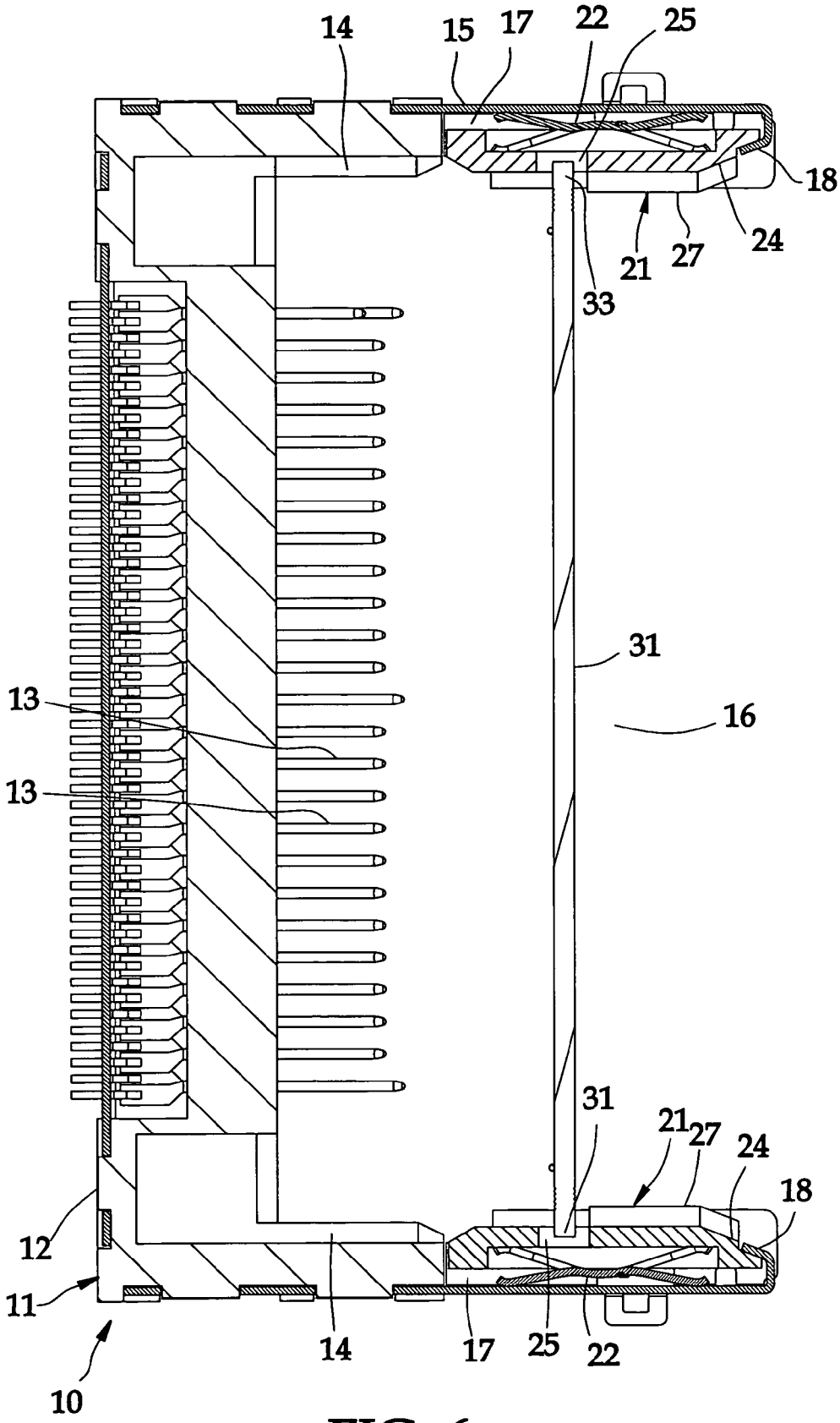
FIG. 6 is a sectional view taken from a line 6-6 indicated in FIG. 5.

The card connector 10 further includes two second resilient members 41, which are torsion springs in this embodiment. The second resilient members 41 have their bodies fitted to the two pivot portions 32 of the stopping plates 31 respectively, each having two action arms 42 positioned in the cavity 191 of the cover 15 and contacting against the stopping plate 31 respectively, for generating resilience keeping movement of the stopping plate toward the stopping position. While moved to the stopping position, the stopping plate 31 contacts against a rear end of the stopping portion 23, as shown in FIG. 5.

Referring to FIG. 5 again, before the card is inserted, the two resilient members 41 work on the stopping plate 31 to keep the stopping plate 31 located at the stopping position and the lock-up portions 33 extend into the lock-up recesses 25 to be at lock-up status.

Figure 7A:
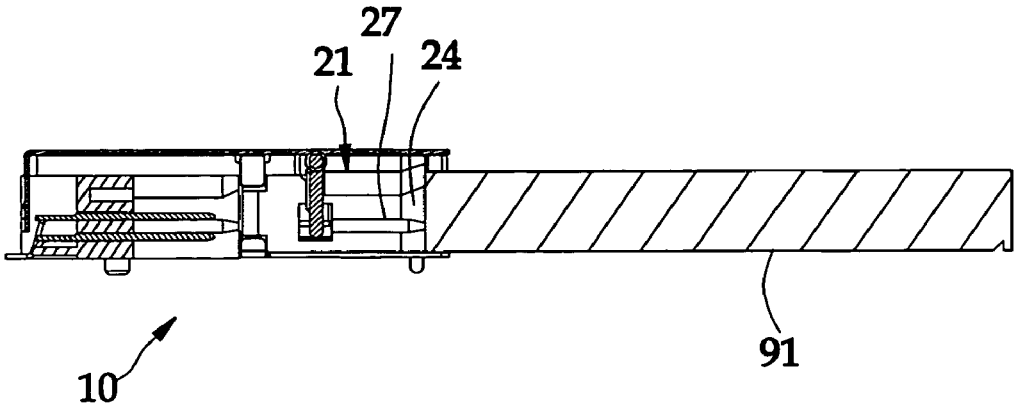
FIGS. 7(A) and 7(B) are a first sectional view and a first top view respectively of the preferred embodiment of the present invention that the card is normally inserted.
Figure 7B:
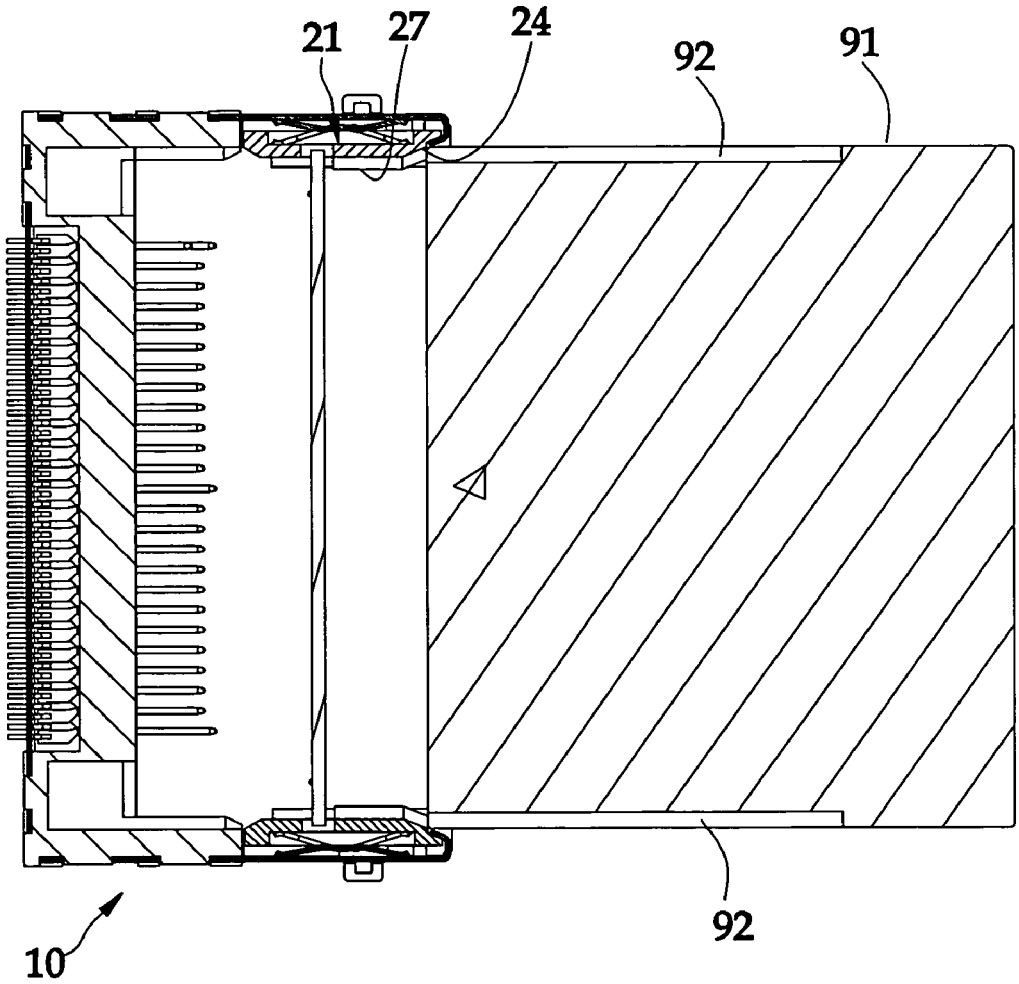
Figure 8A:
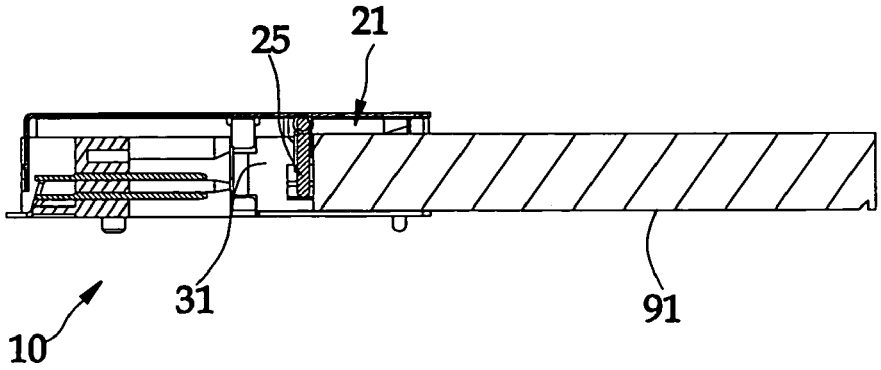
FIGS. 8(A) and 8(B) are a second sectional view and a second top view respectively of the preferred embodiment of the present invention that the card is normally inserted.
Figure 8B:
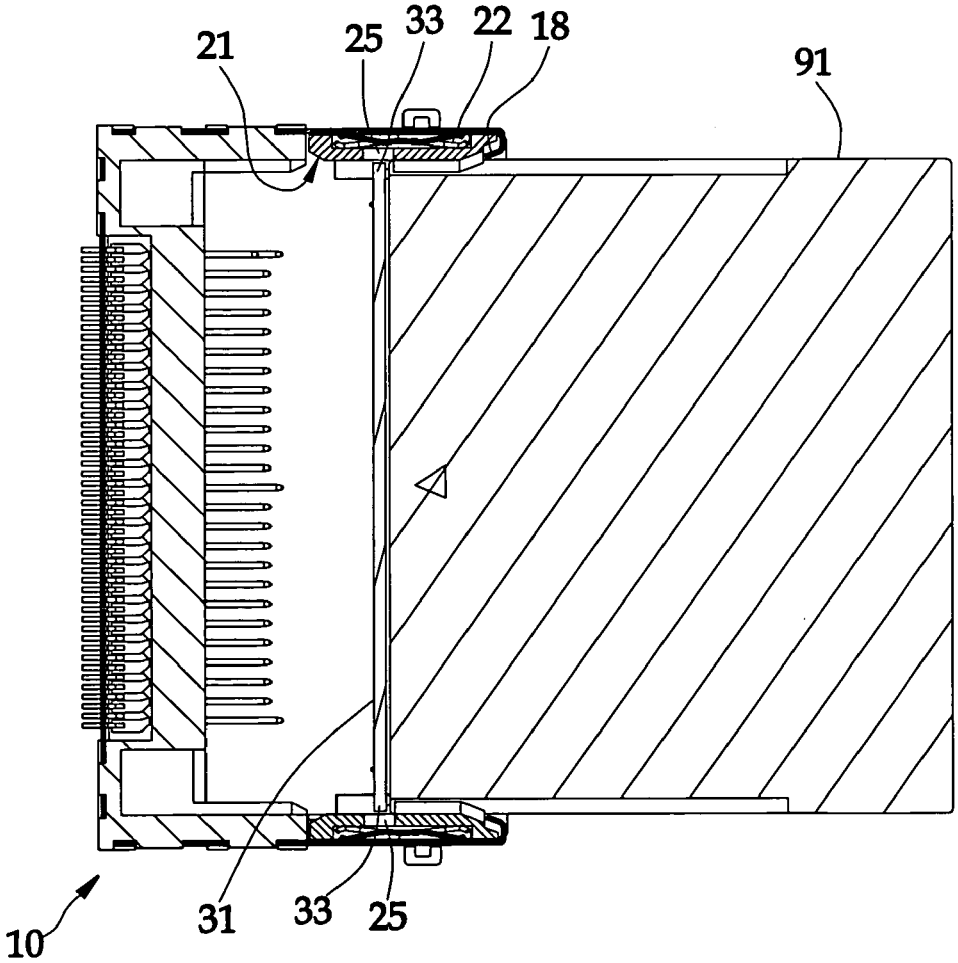
Figure 9A:
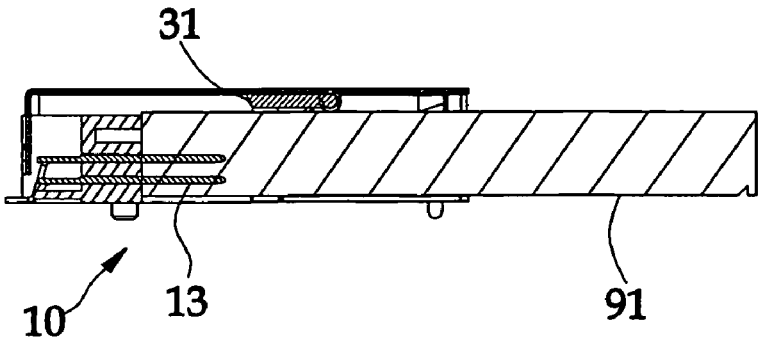
FIGS. 9(A) and 9(B) are a first sectional view and a first top view respectively of the preferred embodiment of the present invention that the card is normally inserted.
Figure 9B:
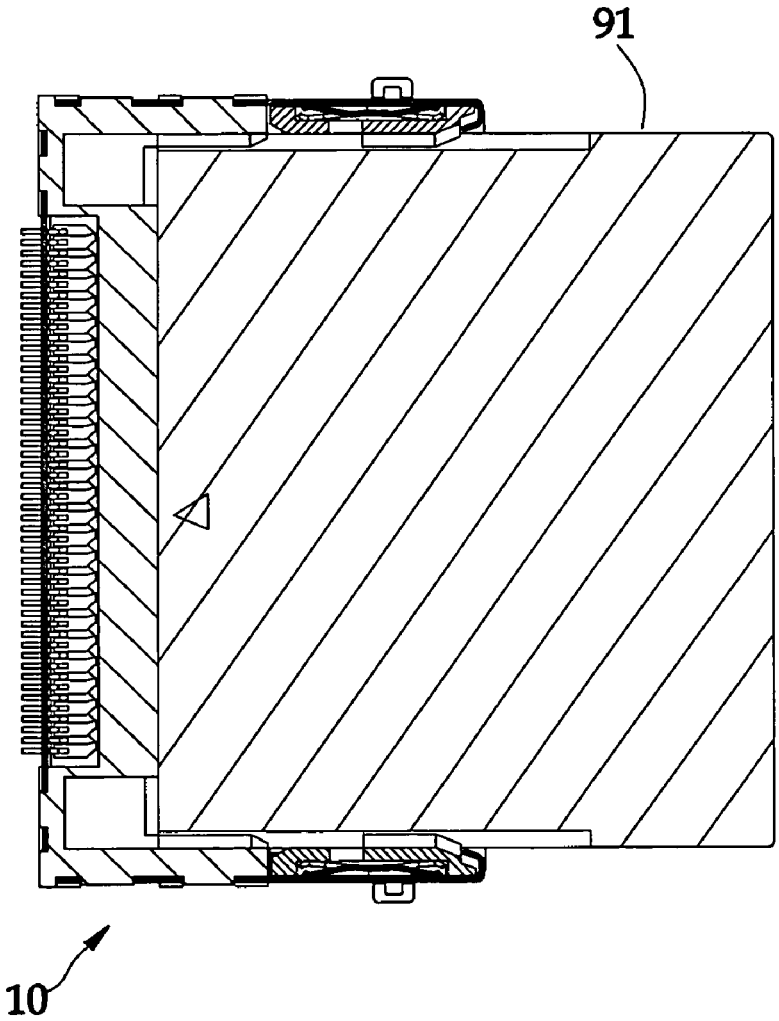

Referring to FIGS. 7(A) and 7(B), while the card 91 (CF card) is normally inserted into the card connector 10, a front side (marked with a triangle) of the card 91 works on the bevels 24 of the two movable members 21, the guide ribs 27 are slid into the slide channels 92 of the card 91 respectively, and the stopping portions 23 are slid into corner grooves 93 (FIG. 3) formed at bilateral sides of a top side of the card 91 to disable stopping the card 91 from entry. Referring to FIGS. 8(A) and 8(B), while the card 91 continues to move further to push the two movable members 21 bilaterally sideward, the lock-up recesses 25 are moved away from the lock-up portions 33 of the stopping plate 31 to release the lock-up status. Referring to FIGS. 9(A) and 9(B), while moved further, the card 91 works on the stopping plate 31 to enable the stopping plate 31 to pivot toward the releasing position and then the card 91 is moved further into a bottom side inside the card connector 10 to be electronically connected with the terminals 13 to accomplish insertion of the card 91. In the meantime, the two guide ribs 14 of the frame 12 are also slided into the slide channels 92 of the card 91. While the card 91 is pulled out, the operation is reverse to the aforementioned one. During the process of ejection of the card 91, the stopping plate 31 is driven by the two second resilient members 41 to pivot downward and then the two movable members 21 are driven by the first resilient member 22 to engage each other; meanwhile, the lock-up portions 33 extend into the lock-up recesses 25 to enable the stopping plate 31 to remain the lock-up status at the stopping position.

Figure 10:
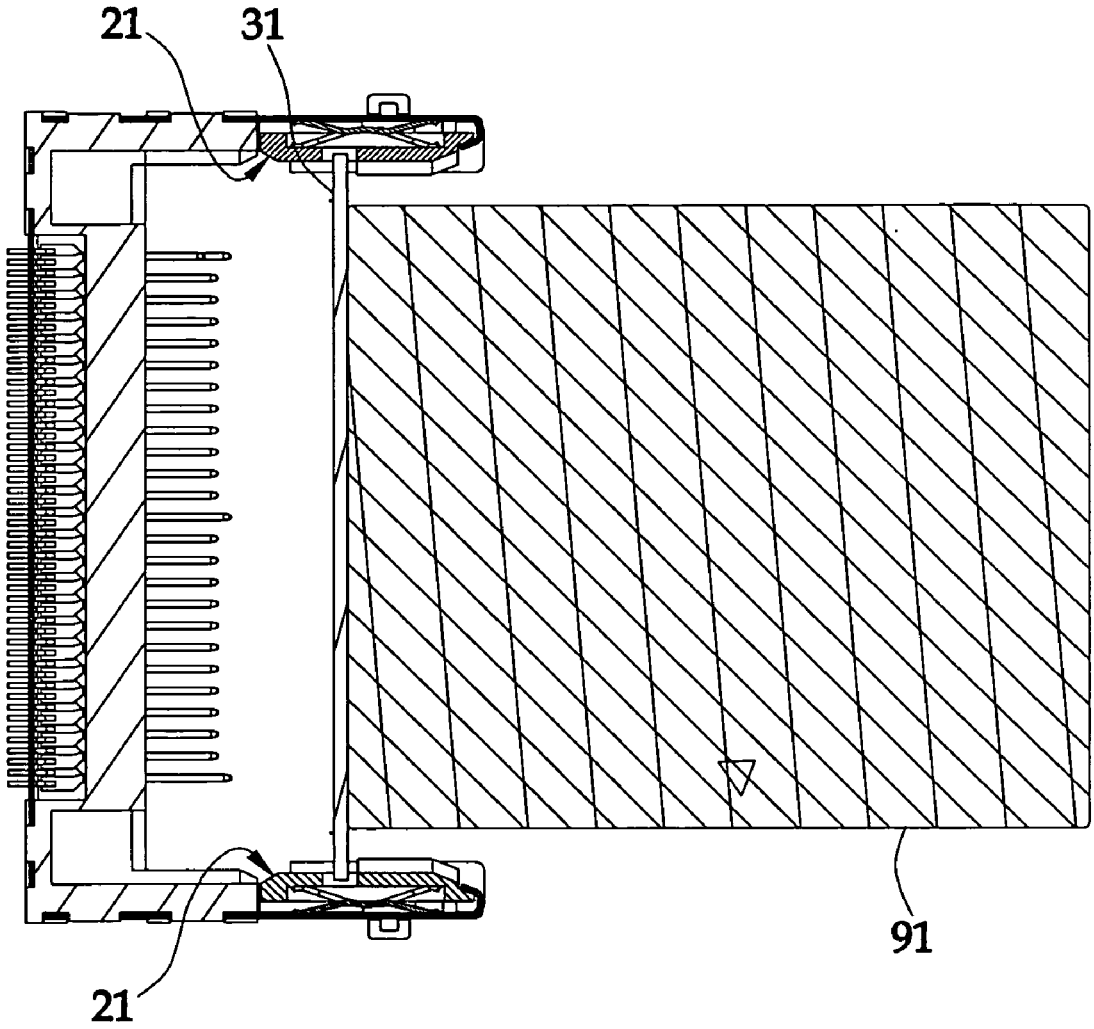
FIG. 10 is a first schematic view of the preferred embodiment of the present invention that the card is erroneously inserted.

Referring to FIG. 10, while the card 91 is erroneously inserted, e.g. the card 91 is inserted with 90-degree rotation with respect to the normal direction into the card connector 10. Because the card 91 is designed with larger width, while the card 91 is inserted in this way, bilateral sides of the front side of the card 91 are not wide enough to work on the movable members 21 and fails to release the lock-up status of the stopping plate 31, such that the stopping plate 31 fails to pivot and the card 91 contacts against the stopping plate 31 to stop moving further, thus blocking erroneous insertion of the card 91.

Figure 11:
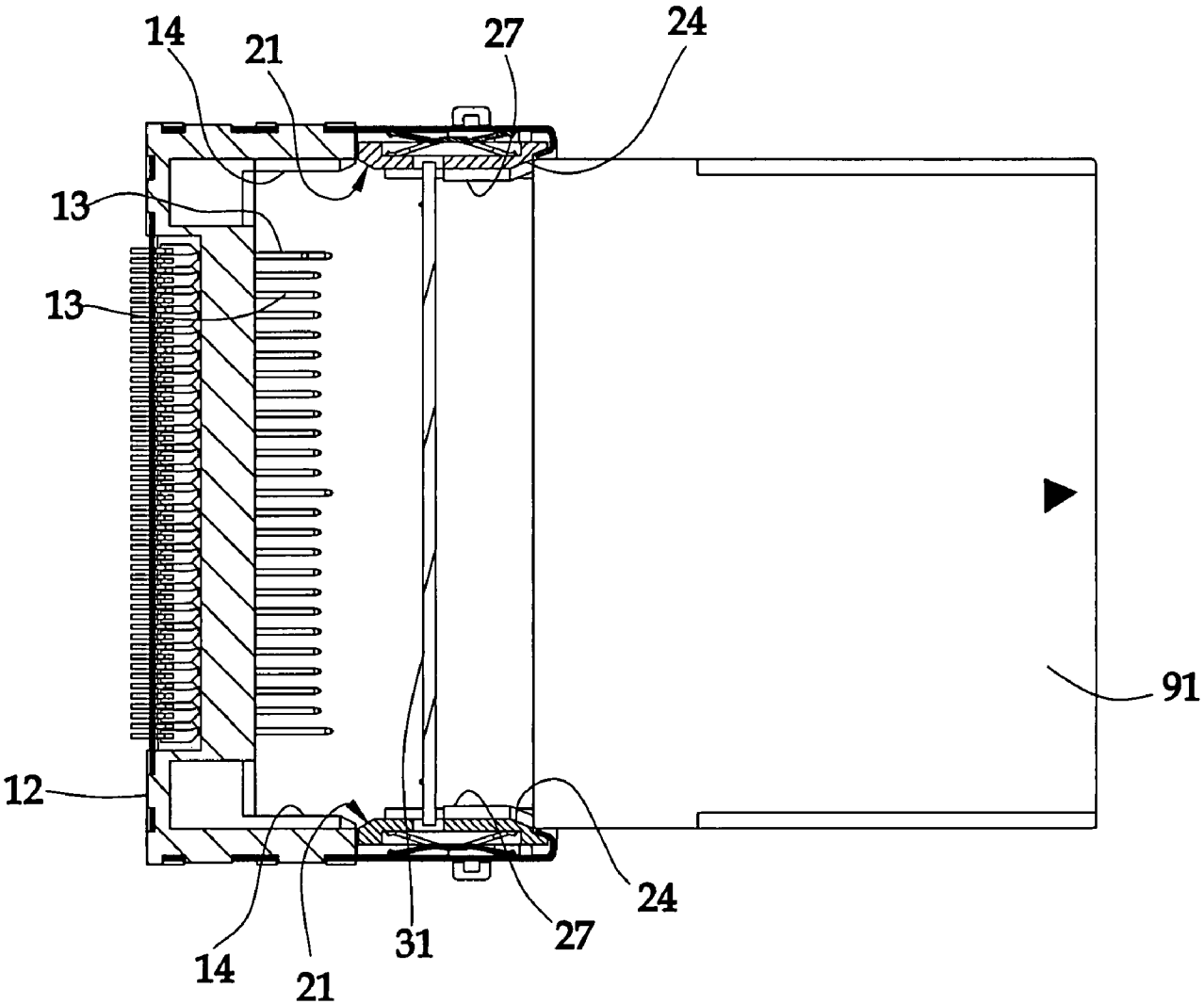
FIG. 11 is a second schematic view of the preferred embodiment of the present invention that the card is erroneously inserted.
Figure 12:
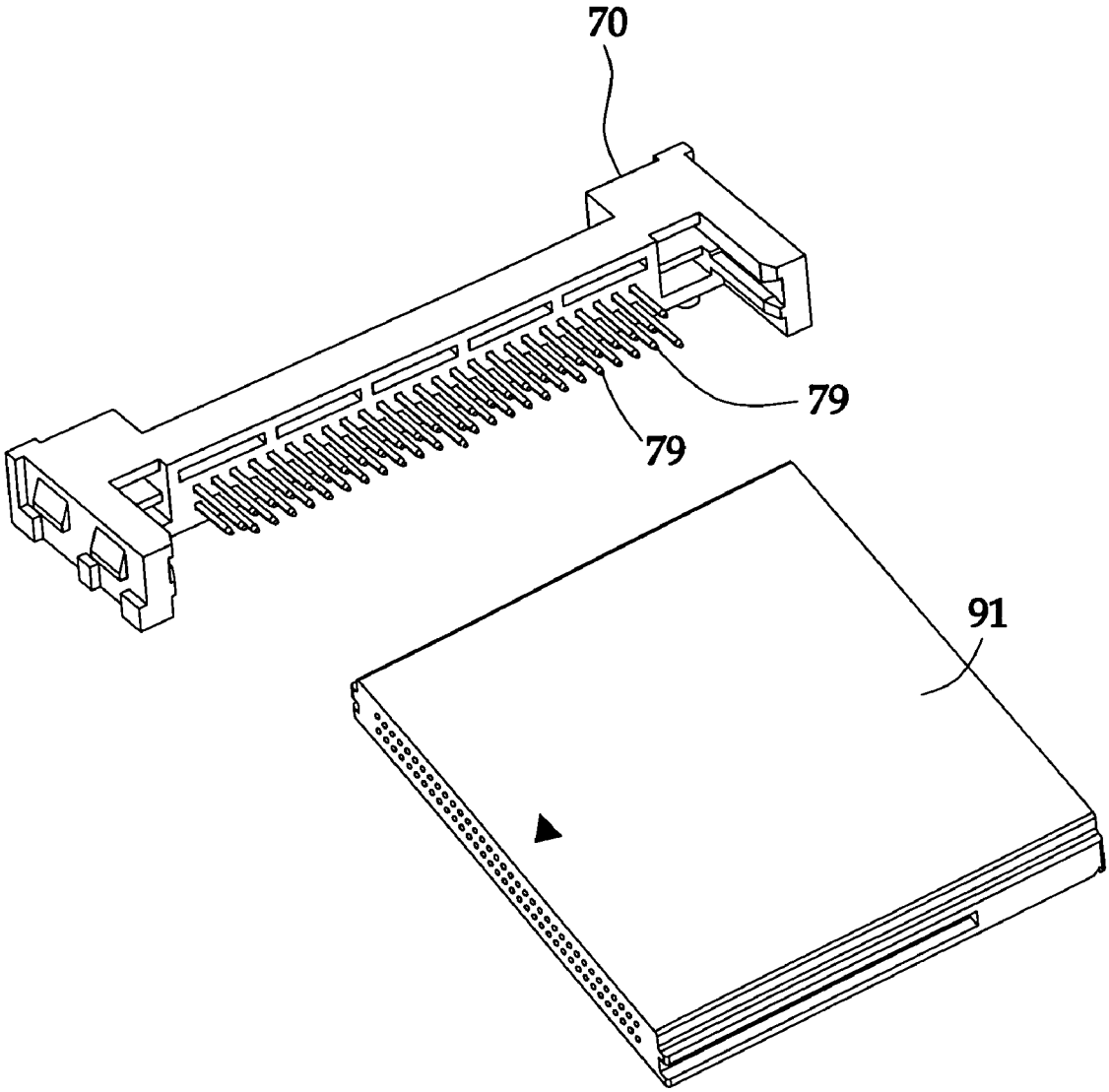
FIG. 12 PRIOR ART
FIG. 12 is a schematic view of the prior art.

Referring to FIG. 11, while the card 91 is inserted in another erroneous way, e.g. the card 91 is inserted with its opposite side facing upward and its rear end facing forward, because there is none of any slide channels formed at bilateral sides of the front end of the card 91, the card 91 contacts against front ends of the two guide ribs 27 and fails to work on the bevels 24 of the movable members 21 and to push the two movable members 21 bilaterally sideward but to be blocked at this position, thus blocking the erroneous insertion of the card 91. Alternatively, the card 91 with its front side facing upward and its rear end facing forward or with its opposite side facing upward and its front end facing forward, will be stopped from insertion as the same as the above-mentioned operation, and thus no further recitation is necessary. If the guide ribs are not provided, the card 91 with its front side facing upward and its rear end facing forward will still work on the movable members 21 to jostle through the stopping plate 31. However, the card with such erroneous insertion still fails to move further and to impinge the terminals 13 because of blockade of the guide ribs 14 of the frame 12.

It is to be noted that only one of the movable members 21 together with one of the retaining portions 18 can be mounted at a side of the cover 15 to stop erroneous insertion of the card 91 as well.

In conclusion, the present invention includes advantages of blocking any erroneously inserted card, further protecting the terminals from damage of crash, and securing no damage to the card connector.

What is claimed is:

1. A card connector capable of avoiding erroneous insertion of an electronic card for protection of terminals thereof, comprising:

a base having an opening, two guide channels, and a retaining portion, said opening being formed at a front end of said base, said two guide channels being formed at bilateral sides of said base and extending inward from said opening, said retaining portion being formed on at least one side of a front section of said base, a plurality of terminals being formed at a rear end of said base;

at least one movable member limited in said guide channels by said retaining portion for movement close to or away from said guide channel within a predetermined range, a first resilient member being mounted between said at least one movable member and said guide channel for generating resilience keeping said at least one movable member away from said guide channel, said at least one movable member having a stopping portion, a bevel, and a lock-up recess, said stopping portion being formed at an upper side of a front end of said at least one movable member, said bevel being formed at a lower side of said at least one movable member and protruding increasingly inward, said lock-up recess being formed at a lateral side of said at least one movable member;

an elongated stopping plate having two ends pivotally mounted to said base for pivoting movement externally driven between a stopping position and a releasing position, said stopping plate having a lock-up portion formed at a side close to said at least one movable member, wherein said at least one movable member is away from said guide channel and said lock-up portion engages said lock-up recess while said stopping plate is located at the stopping position, and said lock-up recess is moved away from said lock-up portion to release lock-up status and to enable said stopping plate to be located at the releasing position; and at least one second resilient member mounted between said base and said stopping plate for generating resilience to cause movement of said stopping plate toward said stopping position, wherein said first resilient member is a plate-like spring and said second resilient member is a torsion spring.

2. The card connector as defined in claim 1, wherein said base includes a frame and a cover.

3. The card connector capable of avoiding erroneous insertion of an electronic card for protection of terminals thereof, comprising:

a base having an opening, two guide channels, and a retaining portion, said opening being formed at a front end of said base, said two guide channels being formed at bilateral sides of said base and extending inward from said opening, said retaining portion being formed on at least one side of a front section of said base, a plurality of terminals being formed at a rear end of said base;

at least one movable member limited in said guide channels by said retaining portion for movement close to or away from said guide channel within a predetermined range, a first resilient member being mounted between said at least one movable member and said guide channel for generating resilience keeping said at least one movable member away from said guide channel, said at least one movable member having a stopping portion, a bevel, and a lock-up recess, said stopping portion being formed at an upper side of a front end of said at least one movable member, said bevel being formed at a lower side of said at least one movable member and protruding increasingly inward, said lock-up recess being formed at a lateral side of said at least one movable member;

an elongated stopping plate having two ends pivotally mounted to said base for pivoting movement externally driven between a stopping position and a releasing position, said stopping plate having a lock-up portion formed at a side close to said at least one movable member, wherein said at least one movable member is away from said guide channel and said lock-up portion engages said lock-up recess while said stopping plate is located at the stopping position, and said lock-up recess is moved away from said lock-up portion to release lock-up status and to enable said stopping plate to be located at the releasing position; and at least one second resilient member mounted between said base and said stopping plate for generating resilience to cause movement of said stopping plate toward said stopping position, wherein said base includes a frame and a cover and said two guide channels are located at bilateral sides of said cover; said retaining portion is located at a front section of each of said guide channels; said at least one movable member is located in each of said retaining portions, wherein said cover comprises two through holes formed at bilateral sides thereof; said stopping plate comprises two pivot portions extending outward from two ends of an upper side thereof, said two pivot portions running through said through holes to enable said stopping plate to be pivoted to said cover, wherein said first resilient member is a plate-like spring, and wherein said second resilient member is a torsion spring.

4. The card connector as defined in claim 3, wherein said torsion spring has two action arms; said cover has two cavities formed at predetermined positions of two bilateral sides thereof for receiving one of said two action arms, said torsion spring being fitted onto one of said two pivot portions, the other of said two action arms contacting against said stopping plate.

5. The card connector as defined in claim 1, wherein said at least one movable member comprises a guide rib extending transversely from a lateral side thereof; and wherein when said movable member is away from said guide channel and said stopping plate is in the stopping position, said guide rib contacts a rear end of said stopping plate.

* * * * *